US005788390A

United States Patent [19]

Law

[11] Patent Number: 5,788,390

[45] Date of Patent: Aug. 4, 1998

[54] RING BINDER

[75] Inventor: Chun Cheung Law, Shatin, Hong Kong

[73] Assignee: Leco Stationery Manufacturing Company Limited, Hong Kong, Hong Kong

[21] Appl. No.: 659,270

[22] Filed: Jun. 6, 1996

[30] Foreign Application Priority Data

Jan. 24, 1996 [GB] United Kingdom ..... 960142

[51] Int. Cl.[6] ..... B42F 3/04

[52] U.S. Cl. ..... 402/38; 402/26; 402/41

[58] Field of Search ..... 402/26, 31, 36–41; D19/26, 27, 32

[56] References Cited

U.S. PATENT DOCUMENTS

| | | | |
|---|---|---|---|
| 813,753 | 2/1906 | Trusell | 402/31 |
| 842,851 | 2/1907 | Boden | 402/41 |
| 904,777 | 11/1908 | Hawkins | 402/37 |
| 919,497 | 4/1909 | Trussell | 402/38 |
| 1,150,719 | 8/1915 | Trussell | 402/40 |
| 1,215,371 | 2/1917 | Hawkins | 402/38 |
| 2,439,675 | 4/1948 | Segal | 402/40 |
| 2,612,169 | 9/1952 | Segal | 402/38 |
| 3,954,343 | 5/1976 | Thomsen | 402/41 |
| 4,566,817 | 1/1986 | Barrett, Jr. | 402/38 |
| 4,919,557 | 4/1990 | Podosek | 402/41 |
| 5,158,386 | 10/1992 | Mann, Jr. | 402/41 |

FOREIGN PATENT DOCUMENTS 1352602 5/1974 United Kingdom .

OTHER PUBLICATIONS

Search Report for GB Application No. 9601412.1 (dated Jan. 22, 1997).

Search Report for GB Application No. 9601416.2 (dated Jan. 22, 1997).

*Primary Examiner*—Willmon Fridie, Jr.

*Attorney, Agent, or Firm*—Fish & Richardson P.C.

[57] ABSTRACT

A ring binder adapted to be fixed to an article includes a support for mounting a plurality of ring members thereon, and a control member movable along a sloped portion on the under surface of the support to cause the support to pivot and thereby open the ring members. The sloped portion on the under surface of the support is provided on at least one of an inturned inner edge of the support and a protrusion extending from the under surface of the support.

36 Claims, 6 Drawing Sheets

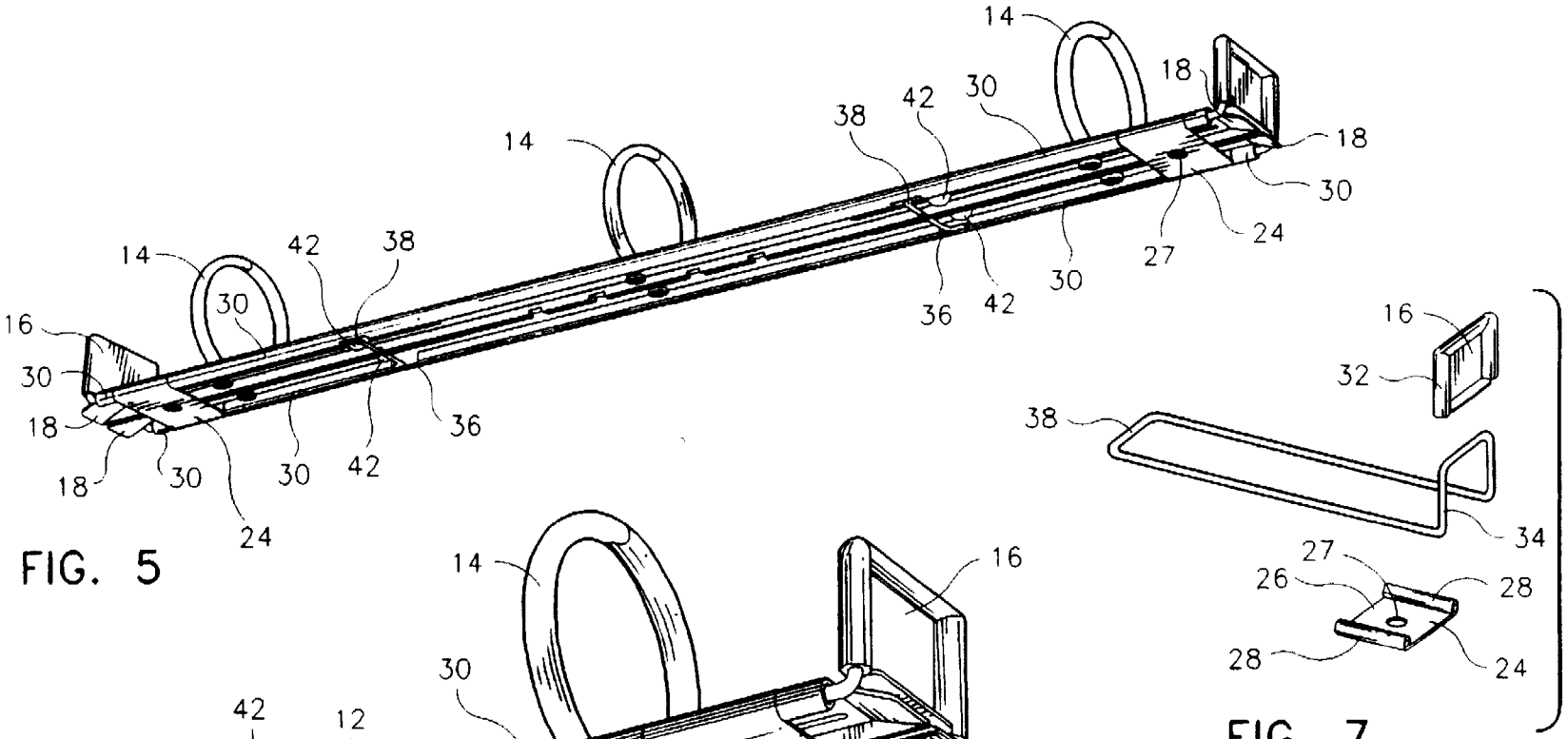
FIG. 7
FIG. 5
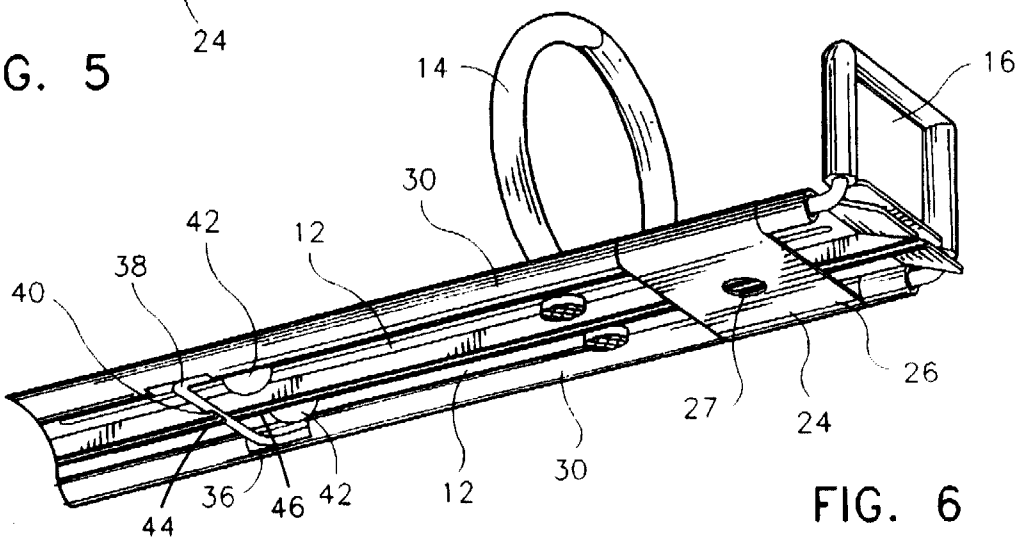
FIG. 6

RING BINDER

This invention relates to a ring binder and, in particular, a ring binder adapted to be fixed to a base member, e.g. a cardboard, paper or metal cover for a folder, book or the like.

Existing ring binders include a substantially rigid upper structure supporting a pair of lower carrier plates which are pivotably movable relative to each other. On each of the lower carrier plates a number of half rings are mounted so that pivoting movement of the lower carrier plates, caused by pivoting movement of a pair of levers one at each end of the ring binder, will close or open the ring members, as desired.

A major problem associated with such existing ring binders is that the opening and closing actions of the ring members are dangerous to the users, as such are brought about by a snapping movement. In addition, in order to withstand the force exerted by the lower carrier plates during their pivoting movement, the upper structure is required to be made of relatively thick, rigid, strong and, thus, expensive materials, which add to the cost of the ring binders, and make assembling and production of the ring binders more difficult. In addition, the upper structure of the ring binders is prone to scratching, e.g. during assembling. Furthermore, as the ring members are closed by a snapping action, jamming of paper between the ring members is common.

It is therefore an object of the present invention to provide a ring binder wherein one or more of the aforesaid shortcomings are mitigated.

According to the present invention, there is provided a ring binder adapted to be fixed to an article by at least one fixing means, the ring binder comprising support means for mounting a plurality of ring members thereon, characterized in that controlling means are provided movable along a sloped portion of the under surface of the support means to cause the support means to pivot and thereby open the ring members.

Suitably, the controlling means are movable to act on a sloping part of the upper surface of the support means to cause the support means to pivot and thereby close the ring members.

Advantageously, the support means comprises a pair of support members pivotally movable relative to each other, wherein the inner edges of the support members are arranged to engage each other on closing of the ring binder and to disengage each other on opening of the ring binder.

Preferably, securing means are provided to hold the support means and secure the support means to an article via said fixing means, said securing means being situated below the support means.

Suitably the controlling means are slidably movable to lock the ring members in the open and/or closed position.

Advantageously, the controlling means open and close the ring binder, and the support means includes locking means co-operable with the controlling means whereby any force applied to the ring members when in their open position will not close the ring members.

Preferably, the controlling means are movable either to open and lock, and/or close and lock, the ring members in one operation.

Suitably, the controlling means are slidably movable to open and/or close the ring members.

Advantageously, the support means comprises a pair of support members supported by holding means joining the outer edges of the pair of support members together.

The support means preferably comprises a plurality of substantially longitudinal rib members on its upper surface.

Suitably, the controlling means open and close the ring binder, and wherein the support means comprises locking means cooperable with the controlling means to lock the ring members in their closed position.

Advantageously, the controlling means open and close the ring binder, and the controlling means acts upon a first location to open the ring binder, and upon it second location to close the ring binder, wherein the first location and the second location are of different distances from the centre of the ring binder.

The support means preferably comprises a pair of support members, wherein one of said support members has at least one engagement member directly cooperable with the other support member during closing of the ring binder.

The invention will now be described by way of example only with reference to the accompanying drawings, wherein:

FIG. 5 shows an underside perspective view of the ring binder in FIG. 1;

FIG. 6 shows an enlarged view of one end of the ring binder in FIG. 5;

FIG. 7 shows an exploded view of the tab, frame member and connecting member of the ring binder in FIG. 1

Figure 2:
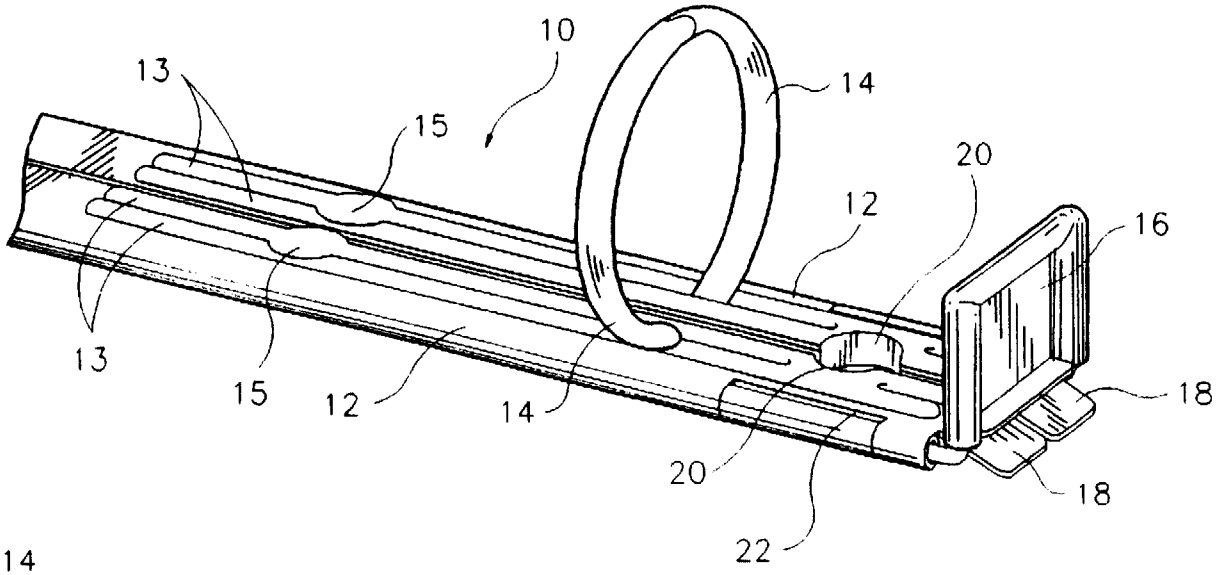
FIG. 2 shows an enlarged view of one end of the ring binder in FIG. 1.
Figure 1:
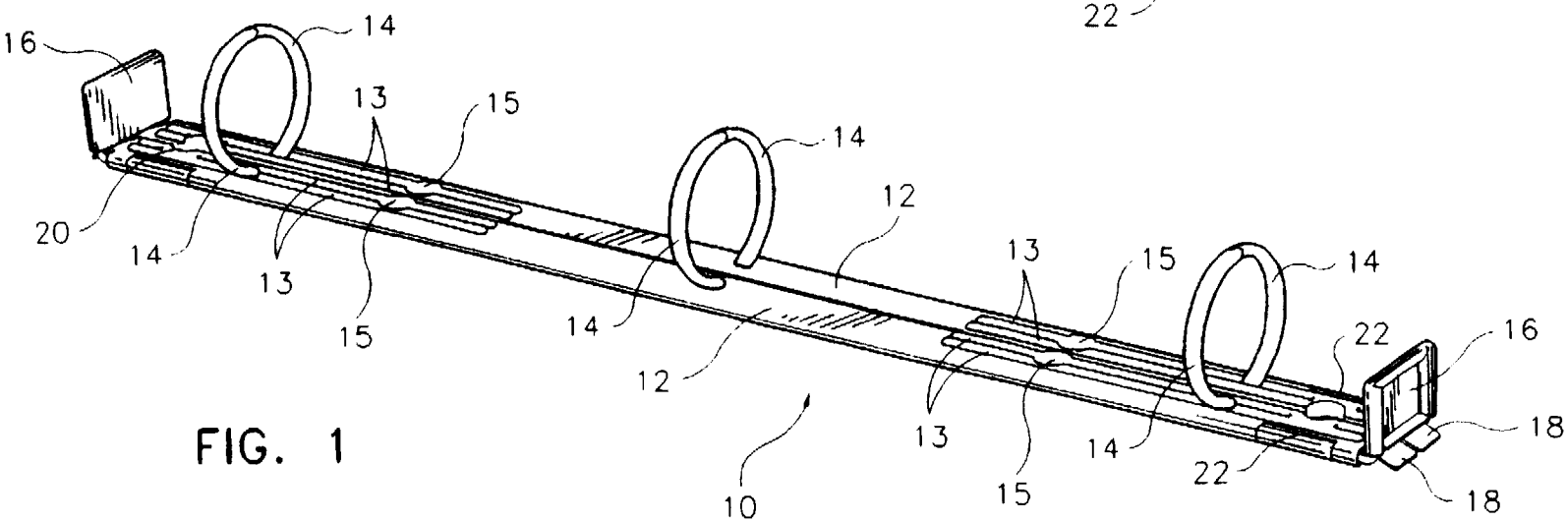
FIG. 1 shows a top perspective view of a ring binder according to the present invention, in which the half rings are in the closed position.

FIGS. 1 and 2 show a ring binder, generally designated as 10, according to the present invention. The ring binder 10 includes support means in the form of a pair of plates 12, each of which is pivotally movable about its respective outer edge in a manner to be described below. Fixedly mounted to each plate 12 are three half rings 14. The corresponding half rings 14 on the two plates 12 mate to form full rings when the ring binder 10 is in the closed position as shown in FIGS. I and 2.

Running along each end of the upper surface of each plate 12 is a pair of longitudinal ribs in the form of upstanding ridges 13 for strengthening the plates 12. The ridges 13 start near the longitudinal ends of the plates 12 and extend beyond the first set of half rings 14 closest thereto. The ridges 13 next to the inner edges of the plates 12 extend around an aperture formed by recesses 20 (to be discussed below) such that they are continuous along their whole length. The ridges 13 assist in preventing scratching of the plates 12, e.g. during the assembling process. The length of the ridges 13 are roughly ⅓ of the whole length of the ring binder 10. Each pair of ridges 13 extend beyond a depression 15 formed on the upper surface of the plates 12. The depressions 15 are present due to hemispheres 42 (to be discussed below) formed on the under surface of the plates 12.

At each longitudinal end of the ring binder 10, controlling means in the form of a control member 16 is provided which is slidably movable in the direction of the longitudinal axis of the ring binder 10. Each of the longitudinal ends of the plates 12 is provided with a downwardly sloping ramp 18. When the control members 16 are moved inwardly from their outermost position towards their innermost position the underside of the base portion of the control members 16 act on the inner edges of the ramps 18 to cause the plates 12 to pivot, and to thereby close the half rings 14. In the position shown in FIGS. 1 and 2, when the ring binder 10 is in the closed position and the control members 16 are in their innermost position, the underside of the base portion of each control member 16 rests on the upper surface of the plates 12. In particular, the ring binder 10 is locked in its closed position, i.e. any opening force applied onto the half rings 14 will not open the ring binder 10, since the ends of the plates 12 are trapped under the base portion of both control members 16. The ring binder 10 is thus locked in its closed position by the control member 16 cooperating solely with the plates 12.

Near each end of the ring binder 10, there is provided on the inner edge of each of the plates 12 a substantially semi-circular recess 20. As shown more clearly in FIG. 2, the two semi-circular recesses 20 on the two plates 12 at the same end of the ring binder combine to form a substantially circular aperture. This aperture may receive fixing means, e.g. a rivet (not shown) therethrough for engagement with a connecting plate 26 of a securing and holding means 24 (to be discussed below) for fixing the ring binder 10 to a base member, e.g. a cardboard, paper or metal cover of a folder or book (not shown). On the outer edge of each plate 12 a pair of first side recesses 22 are provided, each for receiving an end part of the securing and holding means 24.

Figure 4:
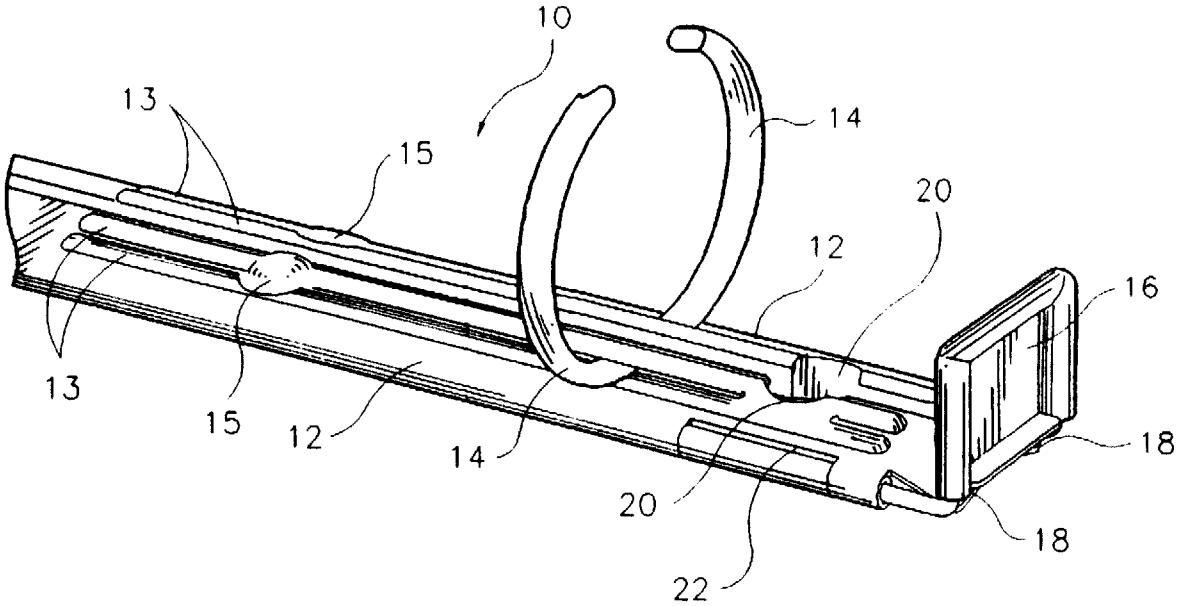
FIG. 4 shows an enlarged view of one end of the ring binder in FIG. 3.
Figure 3:
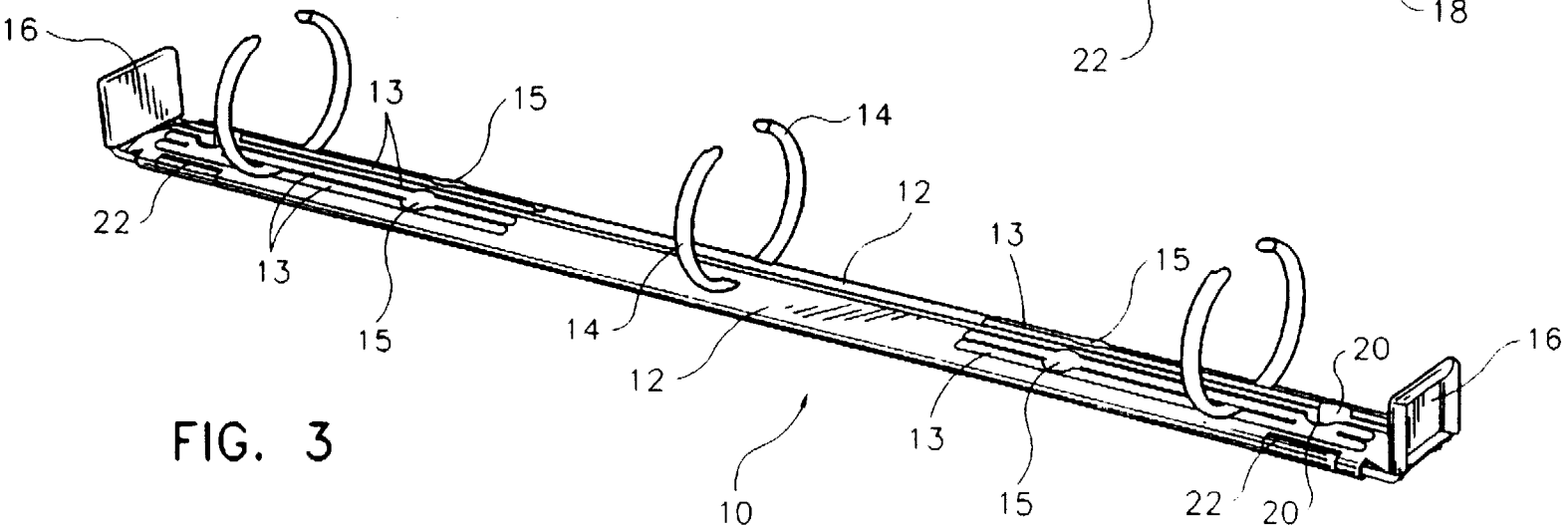
FIG. 3 shows a top perspective view of the ring binder in FIG. 1 in which the half rings are in the open position.
Figure 8:
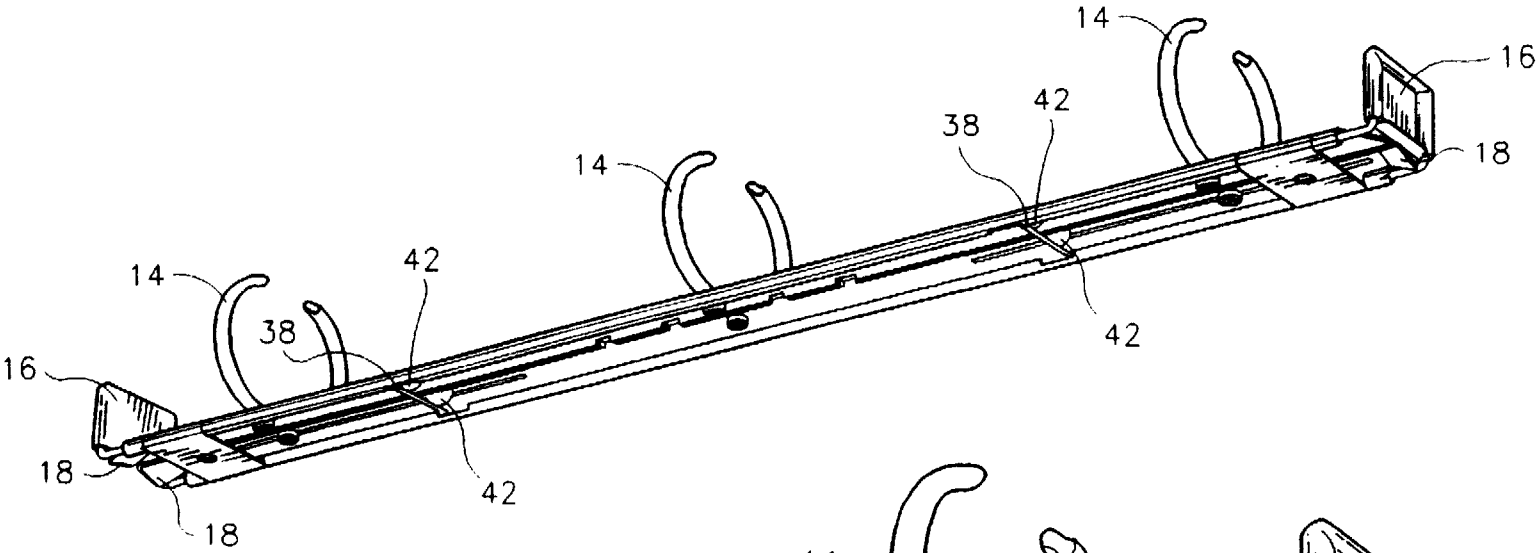
FIG. 8 shows an underside perspective view of the ring binder in FIG. 3.
Figure 9:
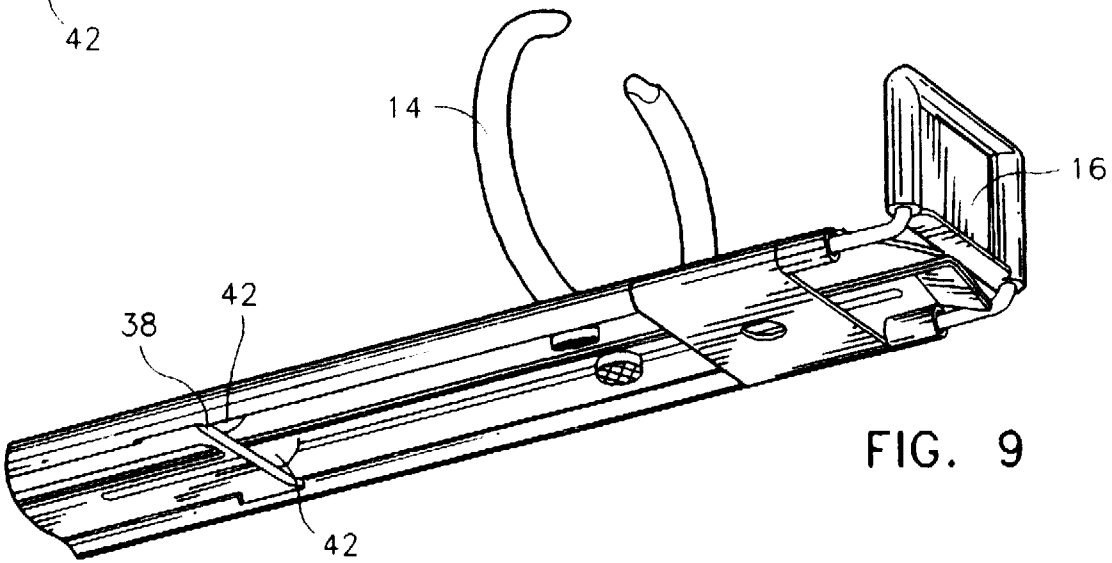
FIG. 9 shows an enlarged view of one end of the ring binder in FIG. 8.
Figure 10:
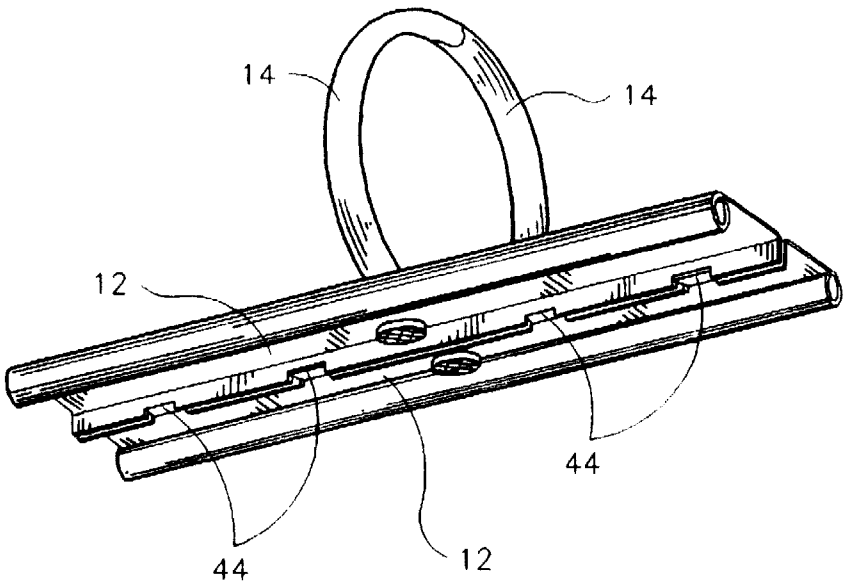
FIG. 10 shows a further enlarged underside view of the ring hinder in FIG. 1.
Figure 11:
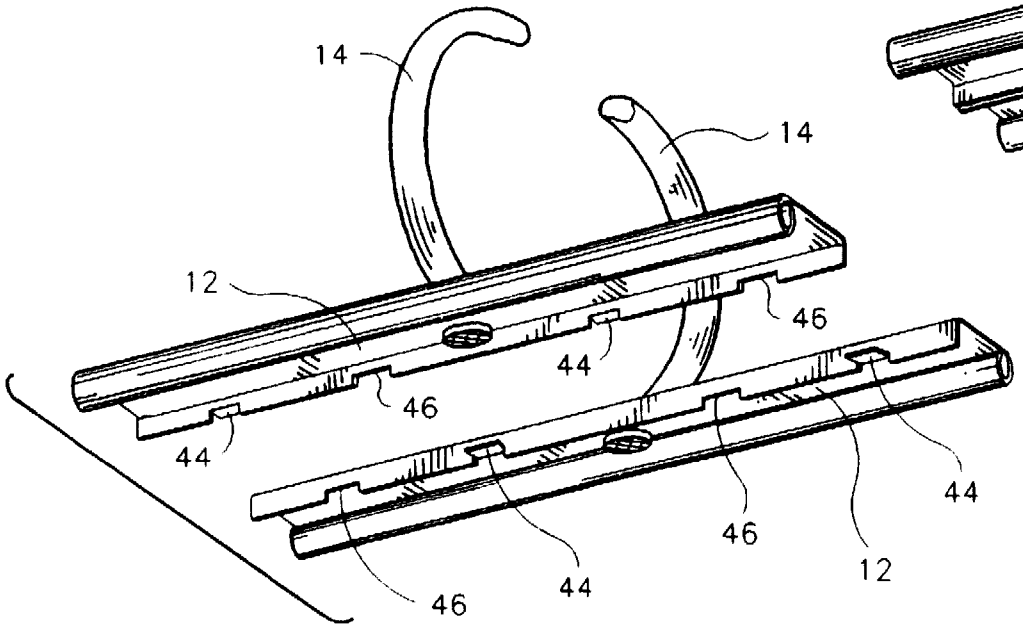
FIG. 11 shows a partial exploded view of the ring binder in FIG. 10.
Figure 13:
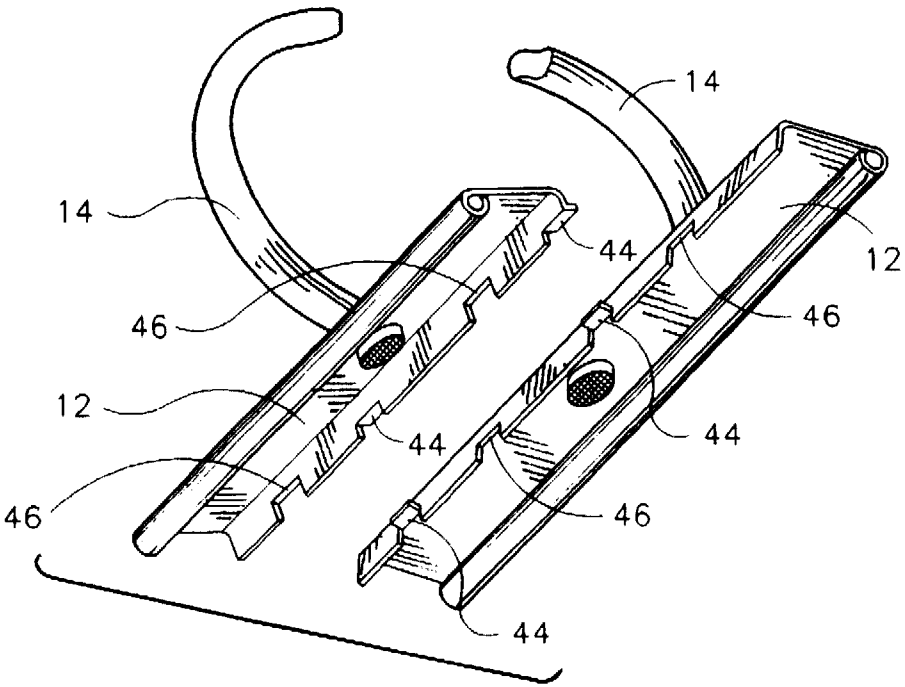
FIG. 13 shows a partial exploded view of the ring binder in FIG. 12.
Figure 12:
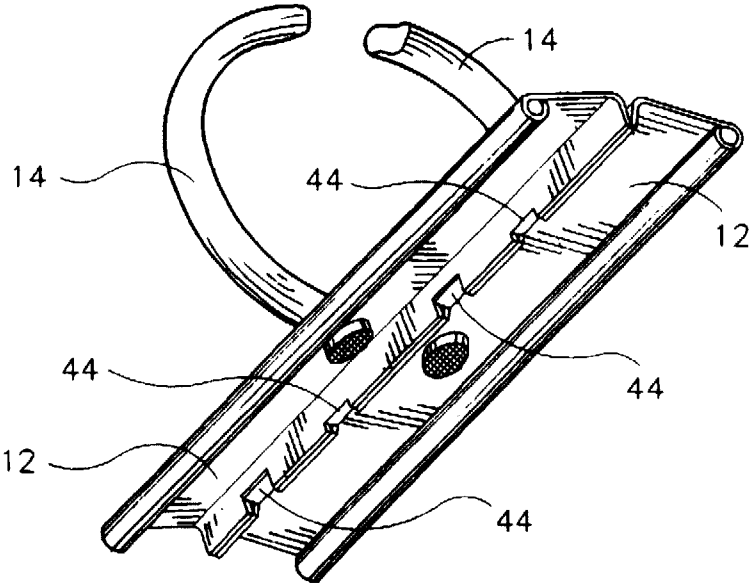
FIG. 12 shows a further enlarged underside view of the ring binder in FIG. 3.

In a manner to be discussed later, the control members 16 may be moved away from each other to open the half rings 14, and lock the half rings 14 in their open position, as shown in FIGS. 3 and 4. In this ring-opened position, the underside of the base portion of the control member 16 will cease to be in full contact with the plates 12, and in particular the ramps 18, although the base still remains touching the inner edges of the ramps 18 in order to limit the amount of pivoting of the plates 12 in the open position of the ring binder.

As shown in FIGS. 5 and 6, the two plates 12 are held in position and the outer edges thereof are joined to each other via two securing and holding means 24 below the plates 12. Each securing and holding means comprises a connecting plate 26 and two connecting means in the form of tubes 28, one tube 28 at each side of the connecting plate 26. The outer edges of each side of the plates 12 are also inturned to form channels 30. The tubes 28 of the securing and holding means 24 are received within the side recesses 22 of the plates 12 to form with the channels 30 a pair of substantially continuous passageways through which a horizontal part of the control member 16 may move. The outer edges of the plates 12 are thus pivotally supported by the holding means 24, the inner edges of the plates 12 being movable away from each other during pivoting (ie during opening of the ring binder).

As shown more clearly in FIG. 7, the control member 16 comprises an upwardly extending tab 32 and a frame member 34. The tab 32 is positioned at each end of the plates 12, and lies in a plane that is transverse to the longitudinal axis of the ring binder. The frame member 34 is formed by bending one end of rectangular wire loop to form a substantially L-shaped member. A shorter upwardly extending portion of the frame member 34 is received within the tab 32, while a longer horizontal portion of the frame member 34 extends below the plates 12 and is received within the passageways formed by the channels 30 of the plates 12 and the side tubes 28 of the securing and holding means 24. The extent of outward movement of the control members 16 is determined by the length of a pair of second side recesses 36 provided on the outer edges of the plates 12.

The frame member 34 also includes a crossbar 38 which is movable between the two extremities of the pair of second side recesses 36. Inward movement of the control member 16 is stopped when the tab 32 of the control member 16 rests against the extreme inner ends of the channels 30, or when a crossbar 38 (to be discussed below) of the control member 16 jams inside a cut out portion 40 (to be discussed below) of the plates 12. Outward movement of the control member 16 is stopped when the crossbar 38 rests against the extreme outer ends of the recesses 36. In this latter position, the base of the control member 16 is not in full contact with the ramps 18, but rather touches only the inner edges of the ramps 18 to limit pivoting of the plates 12. In consequence, the extremities of the movement of the control members 16 represent the ring-opened and locked position, and the ring-closed and locked position.

As shown clearly in FIGS. 5 to 7, the connecting plate 26 is provided with an aperture 27 which is substantially aligned with the substantially circular aperture formed by the two semi-circular recesses 20, to allow fixing means in the form of a rivet to pass through, to thereby secure the ring binder 10 to a base member. Alternatively, the connecting plate 26 may have no hole, and one is only formed when a rivet is punched therethrough. The aperture 27 of the connecting plate 26 may alternatively include a number of downwardly depending gripping members for fixing the ring binder 10 to a cover.

As shown in the drawings, the inner edges of the plates 12 are bent downward and face towards each other. In the closed position as shown in FIGS. 5, 6, 10 and 11, the innermost edges of the plates 12 meet each other along the longitudinal axis of the ring binder 10 to align the plates 12 for ring closing, when the control members 16 with the crossbars 38 are in the innermost position. In the open position, as shown in FIGS. 8, 9, 12 and 13, the innermost edges of the plates disengage from each other.

As shown more clearly in FIG. 6, the middle part of the crossbar 38 is received within a substantially J shaped cut out portion 40 formed on the underside of the plates 12, and in particular on the inturned inner edges of the plates 12. The cut out portion 40 comprises two sloping parts, in which the one nearer to the centre of the ring binder 10 is in the form of an overhanging hooked part 44, while the one nearer to the end of the ring binder 10 is in the form of a straight slope region 46. When the half rings 14 are closed by pushing the control members 16 towards each other, the crossbars 38 are received within the hooked part of the cut out portion 40, and prevent any opening of the half rings 14 due to relative pivoting movement of the plates 12. The crossbars 38 within the hooked part of the cut out portions 40 also further enhances the locking function of the ring binder 10 in the closed position.

When the control members 16 are moved away from each other, the crossbar 38 moves to engage the straight slope region 46 of the cut out portion 40 to cause the inner edges of the plates 12 to rise up and pivot about their outer edges, and thereby to open the half rings 14.

Alternatively, the crossbar 38 may move to engage the surface of a pair of hemispheres 42 on the underside of the plates 12, and thereby open the half rings 14. In this alternative, the crossbars 38 disengages from the straight slope portion of the cut out portion 40 on opening of the ring binder, and engages the surface of the hemispheres facing the centre of the ring binder. The hemispheres 42 provided on the underside of the plates 12 are also designed to aid in the spreading out of any applied force away from the longitudinal axis of the ring binder, and thereby assist in opening/closing of the binder.

When the half rings 14 are opened by slidingly moving the control members 16 to their outermost position, as shown in FIGS. 3, 4, 8 and 9, each of the crossbars 38 rests against the base of the two hemispheres 42, while the plates 12 face away from each other. The crossbar 38 is allowed to rest on the rounded base of the two hemispheres 42 since the crossbar 38 rests against the extreme outer ends of the recesses 36 (in other words, the rounded base of the two hemispheres is positioned adjacent the extreme outer ends of the recesses 36). In this position, the ring binder 10 is also locked as pivoting movement of the plates 12 back to the closed position by forcing the half rings 14 together, is prevented by the base of the hemispheres 42 resting on the crossbar 38. In particular, any force applied on the half rings 14 in an attempt to close them will convert, via the plates 12, into a force passed through the base of the hemispheres 42 against the crossbar 38. It is therefore only possible to close the half rings 14 by moving the control members 16 back to the position shown in FIGS. 1, 2, 5 and 6.

It is clear from the foregoing that a single outward movement of the control members 16 will achieve in one operation both opening and locking of the ring binder 12, while a single inward movement of the control members 16 will achieve in one operation both closing and locking of the ring binder 12, the locking feature being achieved immediately after opening/closing of the ring binder.

In particular, the control member 16 acts at a first location (ie the straight slope region 46 of the cut out portion 40 or the hemispheres 42) to open the ring binder, and at a second location (ie the ramp 18) to close the ring binder, the two locations being at different distances along the length of the ring binder (in other words at different distances from the centre of the ring binder).

As shown in FIGS. 10 to 13, the inner edge of each plate 12 is cooperable with the inner edge of the other plate 12 during closing of the ring binder 10. In particular, each plate 12 is provided with engagement members in the form of two protrusions 44, which are substantially parallel to the upper surface of the plates 12, and two openings 46. Each protrusion 44 of a plate 12 is received within a corresponding opening 46 in the other plate 12. This arrangement further enhances proper alignment of the plates 12 during their relative pivoting movement, and in particular relative alignment of the plates 12 during closing. During opening of the plates 12, the protrusion 44 disengage from the corresponding openings 46, in order to allow the plates 12 to pivot about their outer edges.

It should be noted from the above that, by reason of the present invention, materials of a lower grade may be used to achieve the same strength and rigidity as prior art arrangements. For example, it has been found that while 4B steel is required to be used in convention ring binders, 8B steel may be used for producing ring binders according to the present invention. For ring binders of the same size, a prior art rings binder may weigh up to 70 grams, while one according to the present invention can weigh only 55 grams. Not only does this represent major saving in cost, the saving in material is also environmentally sensitive. Furthermore, as no snapping action is involved in this invention, the ring members are opened or closed much more gently than in prior art arrangements, such that the possibility of jamming paper between the ring members is significantly reduced.

It should be understood that the above only describes an embodiment for carrying out the invention and modifications and/or alterations may be made thereto without departing from the spirit thereof.

I claim:

1. A ring binder adapted to be fixed to an article , the ring binder comprising support means for mounting a plurality of ring members thereon, characterized in that the ring binder further comprises controlling means movable along a sloped portion on the under surface of the support means to cause the support means to pivot and thereby open the ring members, the sloped portion on the under surface of the support means being provided on at least one of an inturned inner edge of the support means and a protrusion extending from the under surface of the support means.

2. A ring binder as claimed in claim 1 wherein the controlling means are movable to act on a sloping part of the upper surface of the support means to cause the support means to pivot and thereby close the ring members.

3. A ring binder as claimed in either claim 1 or 2 wherein the support means comprises a pair of support members pivotally movable relative to each other, and wherein the inner edges of the support members are arranged to engage each other on closing of the ring binder and to disengage each other on opening of the ring binder.

4. A ring binder as claimed in claim 1 wherein securing means are provided to hold the support means, and secure the support means to an article , said securing means being situated below the support means.

5. A ring binder as claimed in claim 1 wherein the controlling means are slidably movable to lock the ring members in open position and in closed position.

6. A ring binder as claimed in claim 1 wherein the controlling means open and close the ring binder, and wherein the support means includes locking means co-operable with the controlling means whereby closing force applied to the ring members when in open position will not close the ring members.

7. A ring binder as claimed in claim 1 wherein the controlling means are movable to open and lock and to close and lock the ring members, each in one operation.

8. A ring binder as claimed in claim 1 wherein controlling means are slidably movable to open and to close the ring members.

9. A ring binder as claimed in claim 1 wherein the support means comprises a pair of support members supported by holding means joining the outer edges of the pair of support members together.

10. A ring binder as claimed in claim 1 wherein the support means has a plurality of substantially longitudinal rib members on its upper surface.

11. A ring binder as claimed in claim 1 wherein the controlling means open and close the ring binder, and wherein the support means includes locking means cooperable with the controlling means to lock the ring members in closed position.

12. A ring binder as claimed in claim 1 wherein the controlling means open and close the ring binder, the controlling means acting upon a first location to open the ring binder, and upon a second location to close the ring binder, and wherein the first location and the second location are at different distances from the centre of the ring binder.

13. A ring binder as claimed in claim 1 wherein the support means comprises a pair of support members, wherein one of said support members has at least one engagement member directly cooperable with the other support member during closing of the ring binder.

14. A ring binder as claimed in claim 1 wherein the sloped portion slopes away from the direction that the controlling means moves in order to open the ring member.

15. A ring binder as claimed in claim 1 wherein the controlling means includes a cross bar member which acts on the sloped portion.

16. A ring binder as claimed in claim 1 wherein the controlling means includes a crossbar member which extends to the outer edge regions of the support means.

17. A ring binder as claimed in claim 1 wherein the support means comprises a pair of support members, and the sloped portion is provided on the underneath of at least one of the support members approximately along the centreline of the support member.

18. A ring binder as claimed in claim 1 wherein the sloped portion is positioned along the longitudinal axis of the ring binder.

19. A ring binder as claimed in claim 1 wherein the sloped portion is sloped away from the base of the support means.

20. The ring binder as claimed in claim 1 wherein the controlling means are slidably movable to open and to close the ring members.

21. A ring binder as claimed in claim 20 wherein the controlling means are movable to act on a sloping part of the upper surface of the support means to cause the support means to pivot and thereby close the ring members.

22. A ring binder as claimed in claim 20 wherein the support means comprises a pair of support members pivotally movable relative to each other, and wherein the inner edges of the support members are arranged to engage each other on closing of the ring binder and to disengage each other on opening of the ring binder.

23. A ring binder as claimed in claim 20 wherein securing means are provided to hold the support means and secure the support means to an article, said securing means being situated below the support means.

24. A ring binder as claimed in claim 20 wherein the controlling means are slidably movable to lock the ring members in open position and in closed position.

25. A ring binder as claimed in claim 22 wherein the controlling means open and close the ring binder, and wherein the support means includes locking means cooperable with the controlling means whereby closing force applied to the ring members when in open position will not close the ring members.

26. A ring binder as claimed in claim 20 wherein the controlling means are movable to open and lock and close and lock the ring members, each in one operation.

27. A ring binder as claimed in claim 20 wherein the support means comprises a pair of support members supported by holding means joining the outer edges of the pair of support members together.

28. A ring binder as claimed claim 20 wherein the support means has a plurality of substantially longitudinal rib members on its upper surface.

29. A ring binder as claimed in claim 20 wherein the controlling means open and close the ring binder, and wherein the support means has locking means cooperable with the controlling means to lock the ring members in closed position.

30. A ring binder as claimed in claim 20 wherein the controlling means open and close the ring binder, the controlling means acting upon a first location to open the ring binder, and upon a second location to close the ring binder, and wherein the first location and the second location are at different distances from the centre of the ring binder.

31. A ring binder as claimed in claim 20 wherein the support means comprises a pair of support members, and wherein one of said support members has at least one engagement member directly cooperable with the other support member during closing of the ring binder.

32. A ring binder as claimed in claim 20 wherein the controlling means is slidingly movable in the direction of the longitudinal axis of the ring binder.

33. A ring binder as claimed in claim 20 wherein the controlling means slides in an inward direction to close the ring binder.

34. A ring binder as claimed in claim 20 wherein the controlling means is slidingly movable in an outward direction in order to open the ring binder.

35. A ring binder as claimed in claim 20 wherein the controlling means comprises an upwardly extending tab portion and a horizontally extending operating portion.

36. A ring binder as claimed in claims 20 wherein the controlling means is slidingly movable in one direction to open the ring member, and slidingly movable in the opposite direction to close the ring member.

* * * * *